United States Patent [19]

Wilcox et al.

[11] 4,186,877

[45] Feb. 5, 1980

[54] BY-PASS NOZZLES

[75] Inventors: Richard L. Wilcox, Adel; Sherman E. Conrad, Des Moines, both of Iowa

[73] Assignee: Delavan Manufacturing Company, West Des Moines, Iowa

[21] Appl. No.: 699,858

[22] Filed: Jun. 25, 1976

[51] Int. Cl.[2] ..... B05B 9/00

[52] U.S. Cl. ..... 239/124

[58] Field of Search ..... 239/124, 126, 602, 406

[56] References Cited

U.S. PATENT DOCUMENTS

| | | | |
|---|---|---|---|
| 1,628,424 | 5/1927 | Peabody | 239/124 X |
| 2,223,055 | 11/1940 | Bergey | 239/124 |
| 2,313,298 | 3/1943 | Martin | 239/124 X |
| 2,374,041 | 4/1945 | Saha | 239/124 X |

*Primary Examiner*—Richard A. Schacher

*Attorney, Agent, or Firm*—Allegretti, Newitt, Witcoff & McAndrews

[57] ABSTRACT

In a fluid by-pass nozzle having a chamber, an inlet orifice for introducing fluid to the chamber, a discharge orifice for discharging fluid from the chamber, and a by-pass for selectively removing a portion of the fluid from the chamber to regulate the spray quantity of fluid discharged from the discharge orifice, the ratio of the cross-sectional area of the inlet orifice to the cross-sectional area of the discharge orifice is less than 1.50.

8 Claims, 3 Drawing Figures

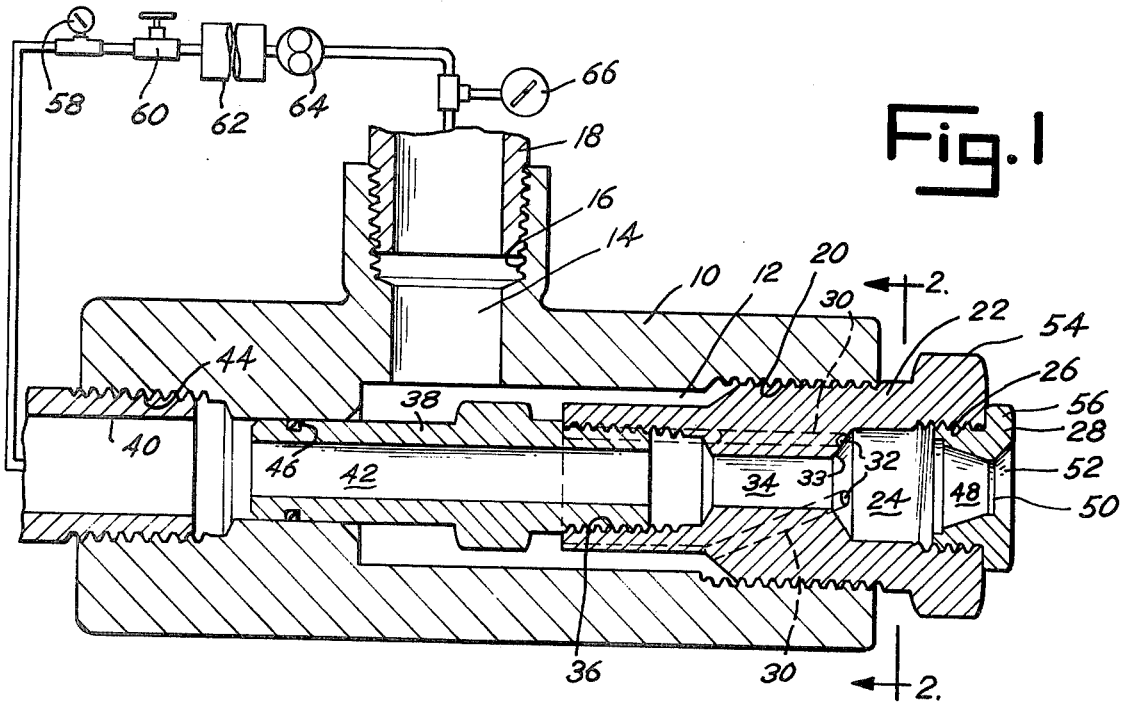
Fig. 1
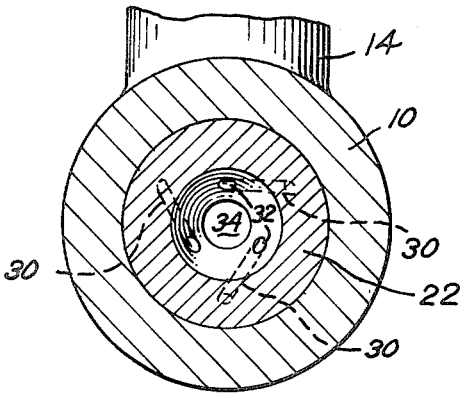
Fig. 2
Fig. 3
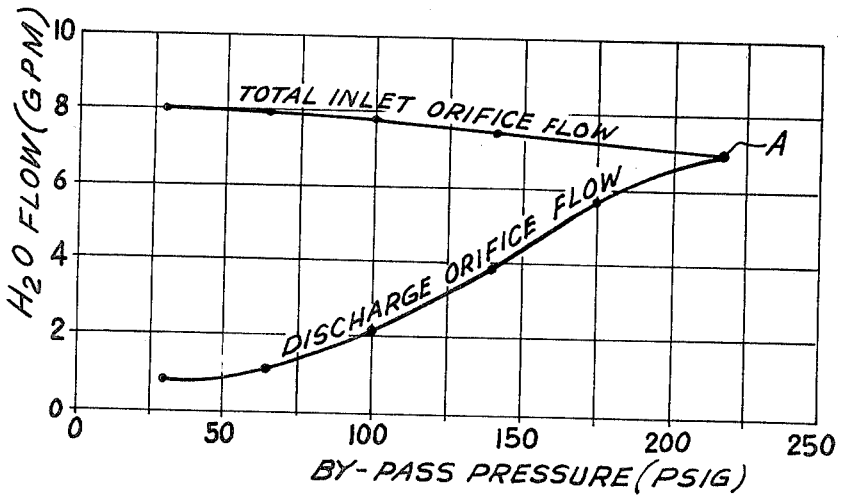

BY-PASS NOZZLES

BACKGROUND AND SUMMARY OF THE INVENTION

This invention relates to fluid nozzles and, more particularly, to fluid nozzles of the spill-back or by-pass type.

The discharge quantity from liquid nozzles has been regulated or modulated for many years by by-passing or spilling back a portion of the fluid introduced to the nozzle. Such nozzles have been variously known as by-pass nozzles, return flow nozzles, recirculating nozzles, spill or spill-back type nozzles and, sometimes, Peabody-Fisher nozzles after the name of the original developers of the nozzle. By-pass nozzles have found wide spread use in the combustion field as fuel nozzles, since the spray discharge from the nozzles may be easily regulated over wide ranges and regulation is simple, inexpensive, and necessitates only a minimum of mechanical parts.

In by-pass nozzles, the liquid is injected into a chamber through one or more inlet orifices which usually enter the chamber tangentially or at an angle to the chamber axis so as to induce a swirling or vortexing of liquid in the chamber. This swirling liquid is then discharged from the chamber in the form of a hollow spray cone through the discharge orifice of the nozzle. In order to regulate or modulate the quantity of flow through the discharge orifice, a by-pass orifice also communicates with the chamber. When the conduit leading from the by-pass orifice is closed, such as by the shutting of a by-pass valve in the conduit, all of the liquid introduced through the inlet orifices into the chamber will be discharged through the discharge orifice in the form of the spray cone. When it is desired to selectively reduce the amount of liquid being discharged so as to modulate the discharge, the by-pass valve is selectively opened so as to by-pass or spill-back some of the liquid introduced into the chamber back to the liquid supply or low pressure side of the system. The amount of liquid exiting through the discharge orifice, therefore, will vary, depending on the amount of liquid which is spilled back through the by-pass conduit.

One of the terms frequently used in the by-pass nozzle art is "turndown ratio". The turndown ratio is a measure of the modulation performance characteristics of the nozzle. More specifically, the turndown ratio is the ratio of the maximum flow from the discharge orifice (for example, when the by-pass is closed) to the flow that exists under any particular set of given operating conditions. For example, if a nozzle's ultimate capability might be a ratio of 50:1 (by-pass fully closed to fully opened), it may at any particular time be operating at a lower turndown ratio of say 4:1 when the by-pass is only partially opened. Therefore, the turndown ratio is a function, at any given time, of the amount of liquid which is spilled back through the by-pass conduit.

One of the major problems arising in prior art by-pass nozzles is that the total flow through the inlet orifices will increase substantially as the amount of liquid being by-passed increases, i.e., as the turndown ratio is increased. This phenomenon is commonly known in the by-pass nozzle art as "total flow growth". Prior art by-pass nozzles commonly experience total flow growths of 30–50% or more at turndown ratios of 3:1. In other words, the total flow through the inlet orifices is 30–50% greater in these nozzles at a 3:1 turndown ratio than when the by-pass is fully closed. Thus, while the quantity of sprayed liquid is being reduced by opening the by-pass valve, the total quantity of liquid which must be supplied to the nozzle, assuming constant pressure to the nozzle, is increasing.

This total flow growth is objectionable for several reasons. One reason is that further increases in the input horsepower requirements of the nozzle are necessary. Some increase in horsepower is inherent in all by-pass nozzles due to the fact that some input energy is always lost because some of the pressurized liquid is simply returned to the low pressure side of the system. Where total flow growth is high, the amount of this wasted energy is high.

An even more significant disadvantage of high total flow growth is that the input pump must be substantially over-designed in capacity so that the measurable increase in total flow can be accomplished over the entire range of operation. Moreover, if the input flow is held constant, such as where the supply pump is a constant displacement pump, instead of allowed to rise, there will be a decrease in the overall nozzle pressure, which could, in turn, degrade spray quality and aggravate variations in spray cone angle.

Some attempts have been made to reduce this undesirable total flow growth. Graham et al, U.S. Pat. No. 1,824,952, attempted to reduce total flow growth by locating a diaphragm valve in the high pressure input conduit to regulate the pressure in response to variations in pressure in the by-pass return conduit. And, in Olches, U.S. Pat. No. 2,290,350, an elaborate system of valves and check valves is disclosed for minimizing total flow growth. Both of these systems are less efficient than the present invention and are considerably more elaborate because they necessitate the provision of additional valves and the like.

It is a principal purpose of the present invention to substantially reduce the total flow growth as liquid is by-passed in a by-pass nozzle. It has been found when practicing the principles of the present invention that modest total flow growth, on the order of less than 15%, may be realized for turndown ratios of 3:1, as compared to total flow growths which are typically 30 to 50% in the prior art nozzles for the same turndown ratio. Since the nozzles incorporating the principles of the present invention substantially reduce total flow growth, the need for complex valve and other control arrangements is minimized, as is the need for excessive pump capacities and energy losses which otherwise accompany large total flow growths. Moreover, in the nozzle incorporating the principles of the invention, variations in the spray angle over wide turndown ratios are minimized and the effects of by-pass flow resistance changes are minimized. The nozzle constructed in accordance with the principles of the invention is capable of virtually infinite turndown ratios and may be easily disassembled and employ interchangeable metering parts.

In the present invention, a fluid by-pass nozzle includes a chamber, inlet orifice means for introducing fluid to the chamber, discharge orifice means for discharging fluid from the chamber, and by-pass means for selectively removing a predetermined portion of the fluid introduced by the inlet orifice means to the chamber to regulate the quantity of fluid discharged from the discharge orifice means. The improvement in such nozzle is that the ratio of the total cross-sectional area of the inlet orifice means to the cross-sectional area of the discharge orifice means is less than 1.50.

These and other objects, features and advantages of the present invention will be more clearly understood through a consideration of the following detailed description.

BRIEF DESCRIPTION OF THE DRAWING

In the course of this description, reference will frequently be made to the attached drawing in which:

FIG. 1 is a cross-sectional side elevation view of a by-pass nozzle constructed in accordance with the principles of the present invention and including a schematic of a simplified liquid system;

FIG. 2 is a cross-sectioned and elevation view of the nozzle as viewed substantially along line 2—2 of FIG. 1; and FIG. 3 is a graph of liquid flow (gpm) v. by-pass pressure (psig) showing both the total inlet orifice flow and the discharge orifice flow in a by-pass nozzle having a total inlet orifice area/discharge orifice area ratio of 0.534 and over a 7:1 turndown ratio.

DESCRIPTION OF THE PREFERRED EMBODIMENTS

Referring particularly to FIG. 1, a liquid by-pass nozzle which may incorporate the principles of the present invention is shown. The by-pass nozzle comprises an adapter 10 having a generally elongate passage 12 extending therethrough. A liquid inlet 14 communicates with passage 12 and may be threaded, at 16, or otherwise adapted, to receive a liquid supply conduit 18. The end of the passage 12 at one end of the adapter is preferably internally threaded at 20 so as to receive a threaded nozzle body 22 as shown in FIG. 1.

The nozzle body 22 includes a vortex chamber 24 of preferably circular cross section. One end of the vortex chamber 24 is internally threaded at 26 to receive a nozzle cap 28 as shown in FIG. 1. A plurality of liquid passages 30, as shown in dash lines in FIGS. 1 and 2, extend through the nozzle body 22. These passages communicate at one end with passage 12 in the adapter 10 and at the other end define inlet orifices 32 which open into chamber 24. Passages 30 extend at an angle to the axis of chamber 24 so that they are displaced from the axis. Passages 30 preferably extend tangentially to the chamber. Thus, liquid which is introduced from passage 12 through passages 30 into the chamber 24 is caused to swirl and form a vortex in the chamber.

Although the inlet orifices 32 are shown in FIGS. 1 and 2 as being circular in shape, they may be rectangular or slotted and, although three passages 30 are shown, as few as one or more than three passages may be present.

As shown in FIG. 1, passages 30, in addition to extending tangentially to the axis of the chamber, also extend at a longitudinal angle to the axis of the chamber 24 and, thereby, open toward the nozzle cap 28 such that the liquid entering the chamber 24 has a component of motion toward the nozzle cap upon entry into the chamber. These passages 32 may, however, also enter the chamber 24 perpendicularly to the chamber axis, rather than extending at the longitudinal angle shown, without departing from the principles of the invention.

A by-pass orifice 33 opens to a passage 34 which extends rearwardly from the chamber 24 through the nozzle body 22. Passage 34 is internally threaded at 36 to receive a by-pass nipple 38 which extends rearwardly through passage 12 as shown in FIG. 1. A suitable by-pass or spill-back conduit 40 communicates with passage 42 for returning by-pass liquid to the low pressure side of the system. By-pass conduit 40 is also threaded at 44 into the adapter 10. An O-ring 46, or other suitable seal, is positioned at the rear of nipple 38 to prevent leakage between passage 12 and conduit 40.

The nozzle cap 28 includes a preferably doubly tapered passage 48 therethrough. The minimum diameter of passage 48 defines a discharge spray orifice 50 through which the liquid is discharged from the chamber 24 in the form of a hollow spray cone. The spray cone angle is generally defined by the angle of the portion 52 beyond the discharge orifice 50.

The exterior of the nozzle body 22 is preferably formed with a hexagonal or other angled shape 54 as is the exterior 56 of the nozzle cap 28 to accommodate a suitable wrench or the like for the assembly and disassembly of the by-pass nozzle.

As is customary in by-pass nozzle systems, the by-pass conduit 40 includes a pressure gage 58 and control valve 60 between the nozzle and the liquid supply tank 62. The gage 58 is spaced a sufficient distance from chamber 24 to insure that the air core of the swirling liquid does not reach the gage, otherwise the pressure readings might be inaccurate. A pump 64 draws liquid from the tank 62 and pressurizes liquid supply conduit 18, the latter of which may also be provided with a suitable pressure gage 66.

It has been discovered that by carefully selecting the total cross-sectional areas of the inlet orifices 32 relative to the cross-sectional area of the discharge orifice 50, total flow growth may be substantially and dramatically reduced. Specifically, it has been found that, if these cross-sectional areas are such that the ratio of the total cross-sectional area of the inlet orifices to the cross-sectional area of the discharge orifices is less than 1.50, such dramatic flow growth reduction is realized. If the ratio is greater than 1.50, the total flow growth generally deteriorates to the total flow growths which plagued the prior art by-pass nozzles. This ratio, however, should not be reduced to too small a magnitude, e.g., less than 0.25, because by-pass modulation may be impaired.

This discovery is surprising and unexpected, since those knowledgeable in the art have believed that relatively large inlet orifices were necessary to prevent impairment of the intended by-pass modulation function. Thus, the prior art by-pass nozzles have generally employed inlet to discharge area ratios which were greater than 1.50. See, for example, Scott, U.S. Pat. No. 2,286,581.

On the contrary in the present invention, it has been found that if the total inlet orifice area to discharge orifice area ratio is reduced to less than 1.50, not only is by-pass modulation just as effective, but dramatic total flow growth improvement is realized. Moreover, it has also been found that reduction of the total inlet orifice area causes the liquid to enter chamber 24 at a much higher velocity and, thereby, substantially improves the flow patterns in chamber 24 during by-pass modulation, as well as results in more consistent droplet size and spray angle over the entire turndown ratio.

It is believed that the substantial improvement realized by reduction of the total cross-sectional inlet orifice area is due to the imposition of resistance in the fluid circuit at the inlet which is of relatively greater magnitude than the resistances at other points in the system, e.g., the resistances at the discharge and by-pass orifices. Thereby, the latter resistances will have relatively little effect on the total flow growth even though one of them, the by-pass resistance, is varied over a wide range. If, on the other hand, the inlet passages are relatively large as they are in the prior art, modulation of the by-pass valve results in a substantial effect on the total flow growth.

To illustrate the dramatic effect of the present invention, the following eleven examples are set forth, each of which are shown for water as the liquid:

| Pressure No. | (psig) | Total Inlet Orifice Area (sq. in.) | Discharge Orifice Area (sq. in.) | Total Inlet Area To Discharge Area Ratio | Turndown Ratio | Total Flow Growth (%) |
|---|---|---|---|---|---|---|
| 1 | 600 | .0155 | .0290 | .534 | 3:1 | 8.6 |
| 2 | 600 | .0155 | .0290 | .534 | 7:1 | 14.3 |
| 3 | 600 | .0174 | .0254 | .685 | 3:1 | 2.1 |
| 4 | 600 | .0174 | .0254 | .685 | 7:1 | 2.1 |
| 5 | 600 | .0174 | .0227 | .767 | 3:1 | 5.0 |
| 6 | 600 | .0174 | .0227 | .767 | 7:1 | 5.0 |
| 7 | 70 | .0048 | .0058 | .821 | 3:1 | 10.8 |
| 8 | 600 | .0765 | .0519 | 1.47 | 3:1 | 13:1 |
| 9 | 600 | .0765 | .0519 | 1.47 | Unable to reach 7:1 turndown | |
| 10 | 440 | .0250 | .0109 | 2.28 | 3:1 | 18.0 |
| 11 | 440 | .0250 | .0109 | 2.28 | 7:1 | 28.5 |

From the above examples, it will be appreciated that as the total inlet orifice area to discharge orifice area ratio is increased toward 1.50, the total flow growth increases substantially. It will also be evident from these examples that the principles of the present invention are applicable to both large and small nozzles. Compare for example, Example Nos. 6 and 7.

It has also been found that substantial changes in inlet pressure do not substantially affect the total flow growth improvement of the present invention once a certain threshold inlet pressure is reached, e.g., 40–50 psig. This fact is of particular importance in by-pass nozzles in which it is desired to extend the turndown ratio both by by-pass modulation and by varying the inlet pressure.

FIG. 3 is a graph showing the overall modulation performance and total flow growth of the nozzle described in Example No. 1 and over a 7:1 turndown ratio. With water supplied at 600 psig to the inlet orifices 32 and the by-pass valve 60 shut, the by-pass pressure was at its maximum, e.g., about 220 psig as shown in FIG. 3. In this condition, all of the fluid supplied to the chamber 24 through inlet orifices 32 was discharged through the discharge orifice 50, e.g., 7 gpm as shown in FIG. 3. In this condition, both the inlet and discharge orifice flow curves meet at point A.

When the by-pass valve 60 was opened to the point that the pressure in the by-pass conduit 40 dropped to 30 psig, the discharge orifice flow dropped to 1 gpm, i.e., a 7:1 turndown ratio. However, at that turndown ratio, the total inlet orifice flow only rose to 8 gpm, as shown in FIG. 3, which represents a total flow growth of only 14.3% over the entire 7:1 turndown ratio.

It should be noted that the total inlet orifice flow curve in FIG. 3 tends to flatten as it approaches 8 gpm and, thus, even higher turndown ratios should be possible with only further minimal increases in total flow growth. This phenomenon was actually observed in Example Nos. 3 and 4 where the turndown ratio was increased from 3:1 to 7:1 without any noticeable change in the total flow growth.

The cross-sectional area ratio of the by-pass orifice 33 to the discharge orifice 50 can also affect the total flow growth, and should not substantially exceed the value required to attain the desired maximum turndown ratio. In most instances, this ratio should be greater than 1.0, otherwise larger percentages of the flow could not be bypassed and by-pass modulation might be impaired, but generally this ratio should not exceed 2.5.

The distance between the inlet orifices 32 and the nozzle cap 28, and the diameter of the chamber 24, should be adequate to insure that a full vortex is formed in the liquid before it is discharged through the discharge orifice 50 and that liquid does not "pile up" behind the nozzle cap. Such "pile up" and incomplete vortex formation might impair the spray quality and the cone. By way of example, in the nozzle of Example No. 1, the distance between the inlet orifices 32 and the nozzle cap 28 was ½ inch and the diameter of chamber 24 was 0.57 inch.

Although the present invention is contemplated to find substantial use in the fields that by-pass nozzles have traditionally found use, i.e., as burners in heating oil and industrial burners and gas turbine engines, the present invention should not be limited to such uses. It is also contemplated that the present invention, particularly due to the substantial improvement in total flow growth characteristics, will also find widespread use in other fields, including agricultural fields, evaporative cooling and spray drying.

Although the present invention has been described in terms of a nozzle in which the vortex chamber 24 discharges directly to the ambient environment through discharge orifice 50, the principles of the invention are equally applicable to plural chamber nozzles of the kind disclosed in Reed, U.S. Pat. No. 3,934,823. In such plural chamber nozzles, the ratio which is of significance in accordance with the principles of this invention is the ratio of the total inlet orifice area which communicates with the initial swirl chamber to the area of the primary orifice leading from the initial chamber to the second swirl chamber.

It will be understood that the embodiments of the present invention which have been described are merely illustrative of a few of the applications of the principles of the invention. Numerous modifications may be made by those skilled in the art without departing from the true spirit and scope of the invention.

What is claimed is:

1. In a fluid by-pass nozzle having a chamber, inlet orifice means for introducing fluid to said chamber, discharge orifice means for discharging fluid from said chamber, and by-pass means for selectively removing a predetermined portion of the fluid introduced by said inlet orifice means to said chamber to regulate the quantity of fluid discharged from said discharge orifice means, the improvement comprising:

the ratio of the total cross-sectional area of said inlet orifice means to the cross-sectional area of said discharge orifice means is less than 1.50.

2. The nozzle of claim 1 wherein said inlet orifice means are displaced from the axis of said chamber to cause said fluid to swirl in said chamber.

3. The nozzle of claim 2 wherein said inlet orifice means communicate substantially tangentially with said chamber.

4. The nozzle of claim 2 wherein said inlet orifice means are directed toward said discharge orifice means.

5. The nozzle of claim 2 wherein said inlet orifice means and said discharge orifice means are separated from each other by a distance sufficient to establish a stable free vortex in said fluid in said chamber prior to the fluid reaching said discharge orifice means.

6. The nozzle of claim 1 wherein said inlet orifice means are directed toward said discharge orifice means.

7. The nozzle of claim 1 wherein said inlet orifice means comprise plural orifices.

8. The nozzle of claim 1 wherein said by-pass means includes orifice means and the ratio of the total cross-sectional area of said by-pass orifice means to said discharge orifice means is between about 1.0 and 2.5.

* * * * *